United States Patent [19]

Whang

[11] Patent Number: 4,612,973

[45] Date of Patent: Sep. 23, 1986

[54] COLD-HEARTH MELT-SPINNING APPARATUS FOR PROVIDING CONTINUOUS CASTING OF REFRACTORY AND REACTIVE ALLOYS

[75] Inventor: Sung-Hyun Whang, Brookline, Mass.

[73] Assignee: Northeastern University, Boston, Mass.

[21] Appl. No.: 646,351

[22] Filed: Aug. 31, 1984

[51] Int. Cl.[4] ..... B22D 11/06; B22D 11/10; B22D 27/15

[52] U.S. Cl. ..... 164/508; 164/256; 164/335; 164/423; 164/429; 164/437; 222/592

[58] Field of Search ..... 164/508, 506, 512, 514, 164/423, 429, 437, 335, 462, 463, 479, 488, 256; 222/590, 591, 592

[56] References Cited

U.S. PATENT DOCUMENTS

| | | | |
|---|---|---|---|
| 2,997,760 | 8/1961 | Hanks et al. | 164/464 |
| 3,820,586 | 6/1974 | Takei | 164/512 X |
| 4,471,831 | 9/1984 | Ray | 164/508 X |

*Primary Examiner*—Nicholas P. Godici

*Assistant Examiner*—J. Reed Batten, Jr.

*Attorney, Agent, or Firm*—Weingarten, Schurgin, Gagnebin & Hayes

[57] ABSTRACT

Cold-hearth melt-spinning apparatus for adapted improved continuous casting of refractory and reactive alloys possesses (1) a cold crucible having a selectively grooved surface operative to reduce both melt "freezing" at the melt/crucible interface and input heating power requirements, and (2) a replaceable nozzle of a refractory material that is friction-fit in an aperture provided therefor in the crucible. The confronting nozzle/crucible walls define a thermally impeding interface which maintains the nozzle at a temperature sufficient to substantially eliminate melt "freezing" in and across the nozzle orifice. The melt is ejected as a molten jet from the crucible by pressure, rapidly quenched on a suitably configured spinning disk into either filaments or flakes, and passed to an environmentally protected processing compartment. Arc heating of the melt is provided by a water-cooled and selectively movable electrode.

22 Claims, 8 Drawing Figures

COLD-HEARTH MELT-SPINNING APPARATUS FOR PROVIDING CONTINUOUS CASTING OF REFRACTORY AND REACTIVE ALLOYS

This invention was made with Government support under Contract N00014-82-K-0597 awarded by the Department of the Navy. The Government has certain rights in this invention.

FIELD OF THE INVENTION

This invention is directed to the field of metallurgy, and more particularly, to a novel cold-hearth melt-spinning apparatus for providing continuous casting of refractory and reactive alloys.

BACKGROUND OF THE INVENTION

Various rapid solidification processes are known for rapidly quenching molten material into useful metals, alloys and non-metals. In rapid solidification through the ordinary melt-spinning technique, the material to be processed is typically heated in a crucible having an orifice, and is ejected through the orifice as a molten jet onto a rapidly spinning disk of high thermal conductivity. The molten jet is rapidly quenched by the rapidly spinning disk and released therefrom typically as a filament.

An arc furnace having a water-cooled copper crucible for the melt-spinning of refractory and reactive metals and alloys is reported by Sung-Hyun Whang et al. in an article entitled, "An Arc Furnace Melt Spinner for the RSR Processing of Refractory and Reactive Alloys," appearing in *Rapid Solidification Processing, Principles and Technologies,* III, National Bureau of Standards, Maryland (December 1982), incorporated herein by reference. The reported arc furnace melt spinner includes a water-cooled copper crucible having a central orifice that is positioned between upper and lower processing chambers in such a way that the chambers are only in fluid communication via the orifice of the crucible. An upper chamber electrode melts and superheats a metal or other material to be melt-spun in the cooled crucible, and a spinning disk is provided in the lower chamber and adjacent the orifice. The chambers are equally pressurized during heating, and the lower chamber is rapidly evacuated during melt-spinning creating a suction which draws the superheated melt through the orifice as a molten jet onto the spinning disk upon which it is rapidly quenched and released as a filament.

In order to create novel microstructures and metal and alloy materials, selected refractory and reactive metals and alloys must be quenched not only rapidly but in a continuous way. Among other material impediments to continuous casting, the superheated melt tends to "freeze" on the confronting wall of the cooled crucible therewith constricting and/or occluding totally the orifice of the crucible. The rate of flow and quantity of material of the molten jet thus either varies, providing non-repeatable casting, or ceases altogether. Moreover, between casting, the "frozen" layer of melt must be physically removed from the crucible and orifice. The removal process, however, often deforms the maleable copper crucible and orifice thereof to such an extent as to necessitate its removal and replacement by another crucible. Furthermore, the heat that is lost from the melt to the cooled crucible in use must be continuously replenished by supplying such additional electrical power as to maintain the molten state, thus necessitating a comparatively large power consumption.

SUMMARY OF THE INVENTION

The cold-hearth melt-spinning apparatus for providing continuous casting of refractory and reactive alloys of the present invention overcomes these and other disadvantages, and contemplates means coupled to the cooled crucible for reducing heat transport from the melt to the confronting wall of the crucible to reduce "freezing" along the melt-to-crucible interface and to reduce power consumption. The present invention further contemplates means coupled to the cooled crucible for maintaining the orifice at a high temperature sufficient to substantially eliminate "freezing" in and across the orifice and therewith to prevent both orifice restriction and occlusion. The heat transport reducing means preferably includes a crucible having a surface having a plurality of selectively dimensioned grooves in a selected surface pattern. The dimensions of the grooves are selected such that the surface tension of the melt prevents it from entering the grooves so that the grooves thereby act to impede heat transport to the cooled crucible and to materially reduce the total melt-to-crucible contact area. In this manner, melting and superheating is achieved with substantially reduced melt "freezing" and input power requirements. The high orifice temperature maintaining means preferably includes a refractory nozzle defining an orifice that is friction-fit in an aperture provided therefor in the crucible. The boundary defined between the confronting walls of the nozzle and crucible defines a high thermal impedance interface. Heat from the melt is thereby retained by the nozzle producing a nozzle temperature that is sufficient to substantially eliminate melt "freezing" on and across the walls defining the nozzle orifice. The nozzle is removably replaceable by a clean nozzle between casting without risk of damage to the crucible.

In a preferred embodiment, the cold-hearth melt-spinning apparatus for providing continuous casting of refractory and reactive alloys of the present invention includes a melting chamber, a subjacent spinning chamber, and a processing chamber in communication with the spinning chamber. The cooled crucible is positioned between the melting chamber and the spinning chamber. An arc-electrode is positioned in the melting chamber adjacent the crucible, and means are provided for moving the electrode in a predetermined pattern for uniformly superheating the melt. Means coupled to the melting and spinning chambers are provided for ejecting the melt through the orifice of the nozzle as a molten jet. Means coupled to the melting chamber are provided for continuously feeding material to the melting chamber to replace ejected material. Means including a distributed gas injector and an apertured cover are provided in the melting chamber for preventing blow-out of the arc produced by the moving electrode. A rapidly spinning disk is provided in the spinning chamber for rapidly quenching the molten jet. The disk may advantageously have either a smooth peripheral surface or a serrated peripheral surface for respectively providing a filament or a particulate output. The processing chamber includes sealed operator manipulation ports and an operator view window. Processed material received in the processing chamber for the spinning chamber can in this manner be packaged, contained, or otherwise suitably processed prior to system removal.

BRIEF DESCRIPTION OF THE DRAWINGS

Other advantages and features of the present invention will become apparent as the invention becomes better understood by referring to the following solely exemplary and non-limiting detailed description of a preferred embodiment thereof, and to the drawings, wherein.

DETAILED DESCRIPTION OF THE PREFERRED EMBODIMENT

Figure 1:
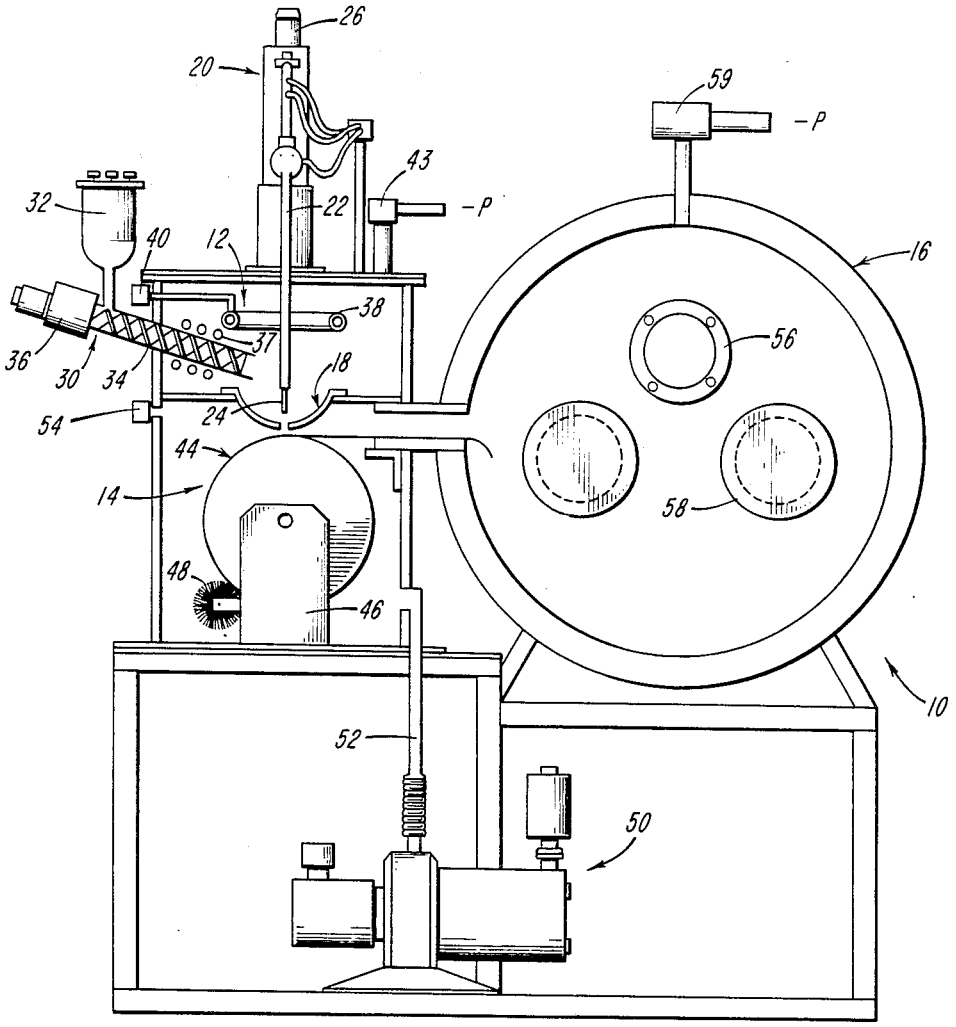
FIG. 1 is a schematic diagram illustrating the cold-hearth melt-spinning apparatus for providing continuous casting of refractory and reactive alloys according to the present invention.

Referring now to FIG. 1, generally designated at 10 is a schematic diagram illustrating the cold-hearth melt-spinning apparatus for providing continuous casting of refractory and reactive alloys according to the present invention. The apparatus 10 is operative to continuously form either crystalline alloys or amorphous alloys in filament or flake form by rapid solidification from the melt. The apparatus 10 includes a melting chamber generally designated 12, a subjacent spinning chamber generally designated 14, and a processing chamber generally designated 16 laterally adjacent the chambers 12 and 14 and in communication with the spinning chamber 14. A crucible generally designated 18 to be described is provided intermediate the melting chamber 12 and the spinning chamber 14. The crucible 18 is charged in a manner to be described with a preselected mixture of elemental powders or prealloyed granules or powders.

Figure 2:
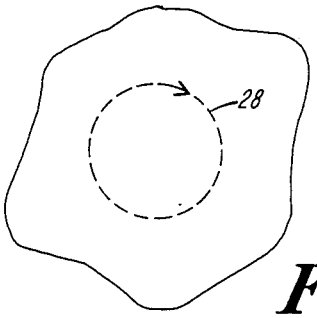
FIG. 2 is a schematic view illustrating a preferred locus of the movement of the arc-electrode of the cold-hearth melt-spinning apparatus for providing continuous casting of refractory and reactive alloys according to the present invention.

A heating device generally designated 20 is mounted to the melting chamber 12 for heating the contents of the crucible 18. The heating device 20 preferably includes an arm 22 having a liquid-cooled and non-consumable electrode tip 24 extending to a point that is proximate the crucible 18. A motor 26 is coupled to the arm 22 for so moving the arm that the electrode tip 24 traces a preselected locus selected to uniformly superheat the contents of the crucible 18. The locus traced by the electrode tip 24 can advantageously be a circular path as illustrated in dashed line 28 in FIG. 2.

A feeding device generally designated 30 is mounted to the melting chamber 12 for continuously charging the crucible 18. The feeding device 30 preferably includes a feed supply bin 32 in communication with a screw conveyor 34. A motor 36 is coupled to the screw conveyor 34 for controlling the rate and quantity of material delivered by the bin 32 to the crucible 18. Induction heating as by coils 37 can be provided for pre-heating the charge.

Figure 3:
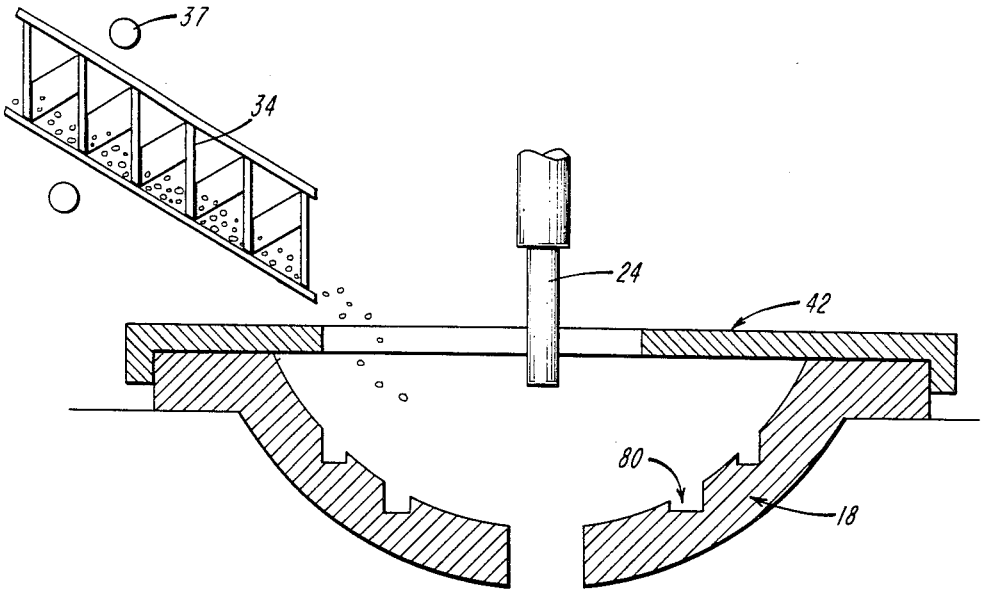
FIG. 3 is a partial sectional view illustrating a cover for the cooled crucible of the cold-hearth melt-spinning apparatus for providing continuous casting of refractory and reactive alloys according to the present invention.

An annular gas discharge manifold 38 is connected via an input gas valve port 40 to a source of pressurized inert gas, not shown, such as helium or argon. An apertured cover generally designated 42 is removably supported on the crucible 18 as illustrated in FIG. 3. The apertured cover 42 is dimensioned both to accept the electrode tip 24 and to receive supply from the screw conveyor 34. The annular gas discharge manifold 38, and apertured cover 42, are cooperative to minimize intrachamber wind induced arc extinguishing. A source of pressurized gas is selectively connectable to the spinning chamber 12 via a pneumatic valve 43.

Figure 1A:
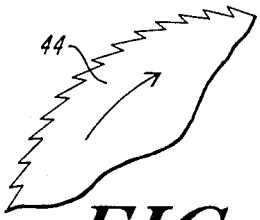
FIG. 1A is a partial side view of the periphery of a serrated-edged spinning disk.

A disk generally designated 44 is rotatably mounted on a support 46 provided therefor in the spinning compartment 14. The peripheral edge of the disk 44 can be smooth whenever it is desirable to continuously produce filaments, and can be serrated whenever it is desirable to continuously produce flakes. A serrated-edged disk is illustrated in FIG. 1A. A brush 48 is mounted to the support 46 for automatically cleaning the peripheral edge of the disk as it rotates. A vacuum pump generally designated 50 is connected to the spinning chamber 14 via a conduit 52, and a source of pressurized inert gas, not shown, is coupled to the spinning chamber 14 via an input gas valve port 54.

A view port 56 is provided on the processing chamber 16 to allow an operator to view the interior thereof. Gloved operator ports 58 are provided on the processing chamber 16 to permit an operator to manipulate the processed product while it remains in a protective environment. A source of negative pressure such as an evacuated chamber is selectively connectable to the processing chamber 16 via a pneumatic valve 59.

Figure 4:
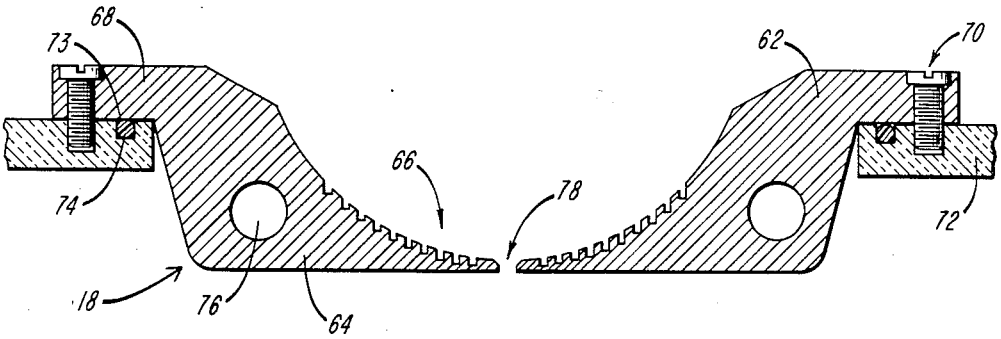
FIG. 4 is a sectional view illustrating the liquid-cooled copper crucible of the cold-hearth melt-spinning apparatus for providing continuous casting of refractory and reactive alloys according to the present invention.
Figure 5:
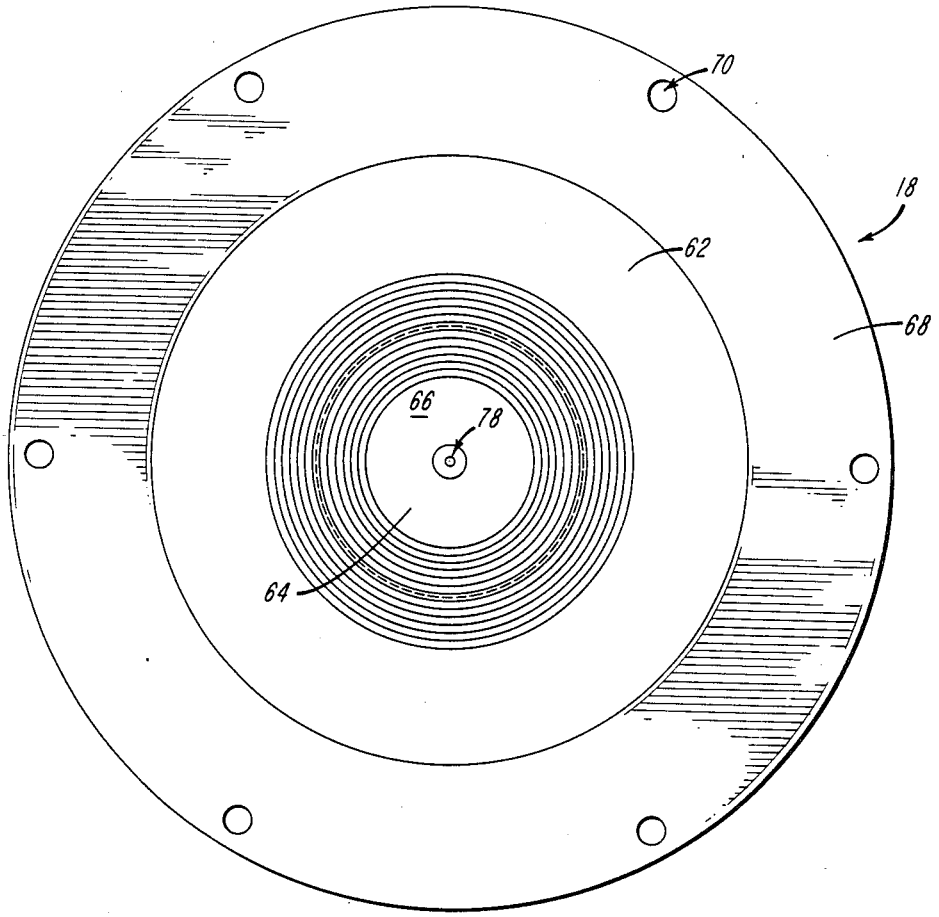
FIG. 5 is a top plan view of the crucible of the cold-hearth melt-spinning apparatus for providing continuous casting of refractory and reactive alloys according to the present invention.

Referring now to FIGS. 4 and 5, generally designated at 18 is a crucible of the cold-hearth melt-spinning apparatus for providing continuous casting of refractory and reactive alloys according to the present invention. The crucible 18 includes an upstanding peripheral wall 62 and an integral interconnecting bottom wall 64 cooperative to define a charge receiving cavity generally designated 66. An annular flange 68 is provided integrally with the wall portion 62 having threaded fastener receiving apertures generally designated 70 therethrough by means of which the crucible 60 is mounted to the bottom wall 72 of the melting chamber 12 (FIG. 1). FIG. 4 shows an O-ring receiving annular groove generally designated 73 provided in the wall 72 for receiving an O-ring 74 which seals the confronting surfaces of the annular flange 68 and the wall 72 in gas-tight engagement. Fluid flow conduits generally designated 76 are provided through the wall portion 62 and peripherally around the crucible 18. A cooling fluid, such as water, is circulated through the conduits 76 for removing sufficient heat from the crucible 18 to maintain it at a temperature selected both to prevent its melting and to prevent chemical reactions between the material of the crucible and the charge therein. A central nozzle receiving aperture generally designated 78 is provided through the bottom wall 64 of the crucible 18. The crucible 18 can be fashioned from any suitable material such as a metal or a refractory material.

Figure 6:
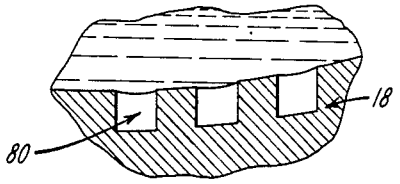
FIG. 6 is a pictorial view illustrating the operation of the grooves of the selectively patterned crucible of the cold-hearth melt-spinning apparatus for providing continuous casting of refractory and reactive alloys according to the present invention.

The surface of the wall 64 confronting the charge receiving cavity 66 is provided with a plurality of grooves generally designated 80 in spaced relation to each other and arranged in a preselected surface pattern. While the grooves 80 can be provided in any desired surface pattern, such as concentrically disposed in the illustrated embodiment, it is important that the width of the grooves be no larger than that dimension at which the surface tension of the melt is no longer sufficient to prevent the melt from being drawn into the grooves by gravitational force, as shown in FIG. 6. The grooves 80 of the crucible 18 thus act to impede heat transport between the melt and the crucible by reducing the melt-to-crucible contact area. The grooved and selectively patterned crucible thereby reduces undesirable "freezing" of the melt at the melt-to-crucible interface. Moreover, the reduced heat loss to the crucible allows the melt itself to be hotter than it would be without the grooves, thus necessitating less electrical power to maintain the melt in the superheated condition.

Figure 7:
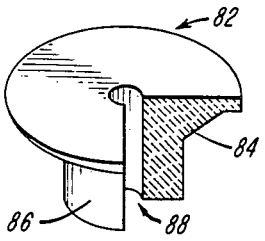
FIG. 7 is a partially broken-away isometric view illustrating the replaceable nozzle of the cold-hearth melt-spinning apparatus for continuous casting of refractory and reactive alloys according to the present invention.

Referring now to FIG. 7, generally designated at 82 is a replaceable nozzle made of any suitable refractory material. The nozzle 82 is friction-fit in the nozzle receiving aperture 78. The nozzle 82 has a beveled annular flange 84 and an integral annular orifice portion 86 defining an aperture generally designated 88. The beveled flange 84 abuts a complementary flange provided therefor around the aperture 78, and the annulus 86 preferably extends beyond the bottom surface of the wall portion 64 of the crucible 18. The mechanical boundary between the confronting walls of the nozzle 82 and the crucible 18 define a high thermal impedance interface. In this manner, the melt in contact with the nozzle 82 heats the nozzle to a temperature much higher than the temperature of the cooled crucible, thereby maintaining it at a temperature effective to prevent melt "freezing" and therewith to eliminate the possibility of a restricted or totally occluded aperture 88. A two-piece nozzle, not shown, can advantageously be employed. The mechanical boundary defined between the confronting walls of outer and inner concentric nozzle pieces likewise defines a high thermal impedance interface operative to reduce heat transport thereacross to further prevent the possibility of orifice restriction and occlusion.

In operation, the crucible is initially charged with preselected material to be melt-spun. The spinning and melting compartments are then pressurized at equal pressures via the gas inlet ports after the system has been evacuated by the vacuum pump. The charge is then uniformly melted and superheated as the electrode traces the locus about the surface thereof. The melting compartment pressure is increased by supplying additional pressurized gas thereto from the source of positively pressurized gas while the spinning compartment pressure is decreased by applying the source of negative pressure thereto for creating a pressure differential across the spinning and melting compartments sufficient to draw the superheated alloy through the nozzle. The resulting molten jet impinges on the peripheral edge of the spinning disk and is rapidly quenched forming either a continuous filament or flakes, which are released into the processing chamber. As the melt is depleted by the exit of the molten jet from the crucible, the conveyor dumps additional material continuously to the crucible at a rate and quantity sufficient to maintain a constant charge in the crucible. The grooves of the crucible not only substantially reduce "freezing" of the melt on the crucible walls, but also substantially reduce input electrical power use as product is being cast in a continuous way. The temperature of the replaceable nozzle is sufficiently high to prevent "freezing" of the melt across the orifice thereof, thereby substantially eliminating the possibility of orifice restriction or occlusion, ensuring repeatable and uniform continuous casting.

By way of example, the apparatus of the present invention can advantageously be employed to continuously form filaments and flakes of titanium and a refractory alloy (Mo-W-Ti (Ta)-C(B)), where the grooves have a width of between 0.5 and 5 millimeters and a depth greater than 0.5 millimeter, and with a quench rate greater than $10^6$ k/second . In this example, the melt has a temperature of around 1500° C., the nozzle has a temperature of between 600° to 1000° C., and the cooled crucible has a temperature of less than 100° C. The superheat at the melt surface has a range of 200° to 1000° C. for titanium alloy and 300° to 800° C. for molybdenum alloys, the surface speed of the spinning disk is in the range of 20 to 30 meters per second, the pressure differential for melt ejection is between 0.02 to 0.05 MPa, and the filament production rate range during spinning is between 6 to 10 g per second. The filament or flake produced in this manner has typically a thickness range of 20 to 80 micrometers and a width range of 1 to 2 millimeters.

It will be appreciated that many modifications of the presently disclosed invention are possible and will be apparent to those skilled in the art without departing from the scope of the appended claims.

What is claimed is:

1. A cold-hearth melt-spinning apparatus for providing continuous casting of refractory and reactive alloys, comprising:

a crucible having first walls defining a charge receiving cavity , said first walls having a surface area confronting said cavity;

first means coupled to said crucible for cooling said crucible;

second means coupled to said cooled crucible for impeding thermal flow between said cavity and said first walls , said second means including a predetermined pattern of spaced grooves having preselected dimensions integrally formed on said surface area of said first walls in such a way that the dimensions of the grooves pattern are selected to be no larger than those dimensions beyond which the surface tension of a melt is insufficient to prevent the melt from wetting the walls of the grooves;

third means coupled to said cooled crucible and in fluid communication with said charge receiving cavity having second walls for providing a molten jet emitting nozzle in such a way that thermal flow is impeded between said second walls and said first walls of said cooled crucible;

fourth means for superheating a charge received in said cavity to form a melt;

fifth means for controllably emitting said melt through said molten jet emitting nozzle in a molten jet stream;

sixth means for charging said charge-receiving cavity;

seventh means for rapidly quenching said molten jet stream to controllably produce quenched material in a desired physical form; and eighth means for receiving said quenched material.

2. The apparatus of claim 1, wherein said first means includes cooling liquid receiving conduits integrally formed within said first walls of said crucible.

3. The apparatus of claim 1, wherein said predetermined pattern is a series of concentric grooves.

4. The apparatus of claim 1, wherein said eighth means includes an environmentally isolated processing compartment.

5. The apparatus of claim 1, wherein said sixth means includes a material transport having a discharge end proximate said charge receiving cavity of said crucible.

6. The apparatus of claim 5, wherein said transport is a conveyor.

7. The apparatus of claim 1, further including ninth means for providing a melting chamber; and tenth means for providing a subjacent spinning chamber; and wherein said crucible is disposed intermediate said melting and said spinning chambers in such a way that fluid communication therebetween is provided only by said molten jet emitting nozzle; and wherein said fifth means includes means coupled to said melting and said spinning chambers for applying a differential pressure therebetween.

8. The apparatus of claim 7, wherein said pressure-applying means is operative to apply a positive pressure to said melting chamber and a negative pressure to said spinning chamber.

9. The apparatus of claim 8, wherein a vacuum pump is operative to apply said negative pressure.

10. The apparatus of claim 1, wherein said seventh means includes a spinning disk.

11. The apparatus of claim 10, wherein said spinning disk has a smooth peripheral surface.

12. The apparatus of claim 10, wherein said spinning disk has an irregular peripheral surface.

13. The apparatus of claim 1, wherein said crucible has a nozzle receiving aperture therethrough; and wherein said third means includes a replaceable nozzle friction-fit in said nozzle receiving aperture in such a way that the interface between the nozzle and the confronting wall of the aperture provided therefor in the crucible defines a thermally impeding boundary therebetween.

14. The apparatus of claim 13, wherein said replaceable nozzle is fashioned from a selected refractory material.

15. The apparatus of claim 1, wherein said heating means includes an arc electrode.

16. The apparatus of claim 15, further including means coupled to said arc electrode for moving said electrode in a preselected spacial locus selected to uniformly superheat the melt.

17. The apparatus of claim 8, wherein said preselected locus is circular.

18. The apparatus of claim 15, further including means for preventing arc blowout.

19. The apparatus of claim 18, wherein said arc blowout preventing means includes an apertured crucible cover and an annular gas inlet manifold.

20. Apparatus for use with a melt-spinning machine for providing continuous casting of refractory and reactive alloys, comprising:

a crucible having a surface defining a charge receiving cavity and having a nozzle receiving aperture;

said surface of said crucible having a groove pattern therein having preselected groove dimensions selected to prevent wetting of the walls of the groove by a charge received in the cavity; and a refractory nozzle having a molten jet emitting orifice therethrough friction-fit in said nozzle receiving aperture of said crucible.

21. The apparatus of claim 20, further including conduits internally formed within said crucible that are adapted to accept a cooling liquid flow therethrough.

22. A cold-hearth melt-spinning apparatus for providing continuous casting of refractory and reactive alloys, comprising:

a crucible having a charge receiving cavity defining a contact surface and having a nozzle receiving aperture;

means coupled to said crucible for cooling said crucible;

said contact surface having a plurality of grooves of dimensions selected to impede heat transport and to reduce the contact area of the surface;

a molten jet emitting nozzle friction-fit in said aperture of said cooled crucible;

means for superheating a charge received in said cavity to form a melt;

means for controllably emitting said melt through said molten jet emitting nozzle in a molten jet stream;

means for charging said charge-receiving cavity; and means for rapidly quenching said molten jet stream to controllably produce quenched material in a desired physical form.

* * * * *

UNITED STATES PATENT AND TRADEMARK OFFICE

CERTIFICATE OF CORRECTION

PATENT NO. : 4,612,973

DATED : September 23, 1986

INVENTOR(S) : Sung-Hyun Whang

It is certified that error appears in the above-identified patent and that said Letters Patent is hereby corrected as shown below:

Column 2, line 66, "for the" should read --from the--.

Column 4, line 60, "crucible 60" should read --crucible 18--.

Signed and Sealed this

Fifth Day of January, 1988

*Attest:*

DONALD J. QUIGG

*Attesting Officer*

*Commissioner of Patents and Trademarks*